United States Patent [19]

Dwyer

[11] 4,328,761

[45] May 11, 1982

[54] SUCTION CUP MOUNTED HOLDER FOR WATERCRAFT

[76] Inventor: William F. Dwyer, 5707 Metcalfe Ct., Shawnee Mission, Kans. 66202

[21] Appl. No.: 36,860

[22] Filed: May 7, 1979

[51] Int. Cl.[3] ..... B63B 59/08

[52] U.S. Cl. ..... 114/222; 16/114 R; 248/206 R; 248/363; 405/186

[58] Field of Search ..... 248/363, 206 R; 182/110; 16/114 R, 110 R, 111 R; 114/222, 221 R; 405/186; 52/729

[56] References Cited

U.S. PATENT DOCUMENTS

| | | | |
|---|---|---|---|
| 2,634,076 | 4/1953 | Van Dusen | 248/206 R |
| 2,932,510 | 4/1960 | Kravitz | 248/206 R X |
| 2,997,300 | 8/1961 | House | 248/363 X |
| 2,998,797 | 9/1961 | Risney | 9/310 A |
| 3,085,541 | 4/1963 | Leach | 114/222 |
| 3,156,943 | 11/1964 | Groomer et al. | 16/110 R |
| 3,716,957 | 2/1973 | Bernardi | 52/729 X |
| 3,918,666 | 11/1975 | Florian | 248/206 R X |

*Primary Examiner*—Sherman D. Basinger
*Attorney, Agent, or Firm*—L. S. Van Landingham, Jr.

[57] ABSTRACT

A suction cup mounted holder is provided for waterborne watercraft which may be easily attached and detached to the exterior hull surface both above and below the waterline, and without penetrating or permanently disfiguring the exterior hull surface. The holder is especially useful in securing a swimmer or diver in the water during cleaning and maintaining the exterior hull surface. This may be accomplished while the watercraft is waterborne and without the expense and inconvenience of drydocking or otherwise removing the watercraft to dry land. A waterborne watercraft is also disclosed which has the holder of the invention releasably attached thereto to thereby allow the exterior hull surface to be cleaned and maintained by swimmers and/or divers. In a further aspect, a novel method is disclosed for cleaning and maintaining the exterior hull surface of a waterborne watercraft by swimmers and/or divers.

36 Claims, 5 Drawing Figures

SUCTION CUP MOUNTED HOLDER FOR WATERCRAFT

THE BACKGROUND OF THE INVENTION

1. The Field of the Invention

The present invention relates to a suction cup mounted holder which is adapted to be grasped by the hand, and which is useful in cleaning and maintaining the exterior hull surface of a watercraft while the watercraft is waterborne. The invention further relates to a waterborne watercraft which has one or more of the holders of the present invention releasably attached thereto whereby the exterior hull surface of the watercraft may be cleaned and maintained while waterborne. In another aspect, the invention is concerned with a novel method of cleaning and maintaining the exterior hull surface of a waterborne watercraft which employs the holder of the present invention releasably attached thereto for the purpose of securing swimmers and/or divers in the water.

2. The Prior Art

As is well known in this art, the exterior hull surface of a watercraft, and especially below the waterline, becomes fouled with a variety of substances which tightly adhere thereto. These fouling substances damage the exterior hull surface in some instances, and they are always unpleasant and unattractive. They additionally tend to seriously hamper the ability of a watercraft to operate and manuever.

Examples of hull fouling substances include living organisms such as bacteria, algae and barnacles, and non-living organic and inorganic substances such as oil, dirt, and other particulate matter initially present in the water. These substances gradually accumulate on the exterior hull surface, and eventually they must be removed by scraping, scrubbing, sandblasting, or other methods of cleaning. Also, the exterior hull surface must be properly maintained periodically by painting, calking, and repairing as necessary to assure that the hull is always in a seaworthy condition.

Heretofore, it was the usual practice for watercraft owners and watercraft servicing facilities to drydock the watercraft or otherwise move the watercraft from the water onto dry land. The exterior hull surface was then cleaned and maintained by individuals working on the dry land. This mode of cleaning and maintaining watercraft is objectionable as it is both expensive and inconvenient.

Efforts have been made heretofore to clean and maintain the exterior hull surface of a waterborne watercraft. These prior art efforts required that one or more divers or swimmers be positioned in the water alongside the waterborne watercraft. Maintenance equipment was provided such as scrub brushes, sponges, detergents, tools and the like. When the divers or swimmers attempted to use the maintenance equipment, it was difficult for them to maintain their buoyancy and a suitable position in close working proximity to the watercraft as there was no convenient stationary item to grasp. As a result, the divers or swimmers could not perform the necessary tasks. It was also dangerous as often the divers or swimmers tended to become snarled in anchor lines, rudders, propellers and the like due to their inability to maintain buoyancy and a desired position in the water relative to the watercraft.

It is apparent from the foregoing that the art has long sought an entirely satisfactory apparatus and method which will avoid the great expense and inconvenience of having to clean and maintain the exterior hull surface of watercraft in drydock or on dry land, and yet overcome the disadvantages and deficiencies of the prior art efforts to clean the exterior hull surface of waterborne watercraft by means of divers and/or swimmers. However, there was no entirely satisfactory method and apparatus for accomplishing this prior to the present invention.

THE SUMMARY OF THE INVENTION

The present invention overcomes the aforementioned disadvantages and deficiencies of the prior art by providing a suction cup mounted holder which is capable of being releasably attached to the exterior hull surface of a watercraft either above or below the waterline. When attached to the exterior hull surface, a diver or swimmer working in the water alongside the watercraft may grasp the holder and maintain his buoyancy and position. Inasmuch as the holder may be easily attached and detached both above and below the waterline, it is apparent that the divers or swimmers may move it as many times as necessary and clean and maintain the entire exterior hull surface. The invention also provides a waterborne watercraft having the holder of the invention releasably attached thereto whereby it may be cleaned and maintained by divers and/or swimmers working alongside in the water. In a further aspect, the invention provides a method of cleaning and maintaining the exterior hull surface of waterborne watercraft which employs the holder of the invention as a means for the divers and/or swimmers to maintain their buoyancy and a proper position in the water.

It will be appreciated that the aforementioned holder, the waterborne watercraft having the holder releasably attached thereto, and the method of cleaning and maintaining the exterior hull surface of a waterborne watercraft employing the holder have certain preferred variants and embodiments. These preferred variants and embodiments will be discussed with greater particularity hereinafter in the detailed description of the invention. The present invention is intended to embrace these further preferred variants and embodiments, as well as any additional variants and embodiments which will be apparent to those skilled in this art upon considering the applicant's teachings in the light of the prior art.

A BRIEF DESCRIPTION OF THE ACCOMPANYING DRAWINGS

The present invention will be described hereinafter in greater particularity with reference to the presently preferred variants and embodiments thereof illustrated in the accompanying drawings, wherein.

Figure 4:
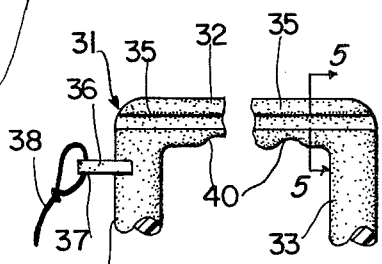
FIG. 4 is a side view in elevation, with portions thereof being broken away, of a holder similar to FIG.
Figure 5:
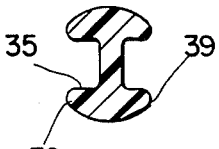

2, but further illustrating a modified configuration for the horizontally extending handle portion; and FIG. 5 is a cross-sectional view taken along the line 5—5 of FIG. 4.

THE DETAILED DESCRIPTION OF THE INVENTION INCLUDING THE PRESENTLY PREFERRED VARIANTS AND EMBODIMENTS THEREOF

Figure 1:
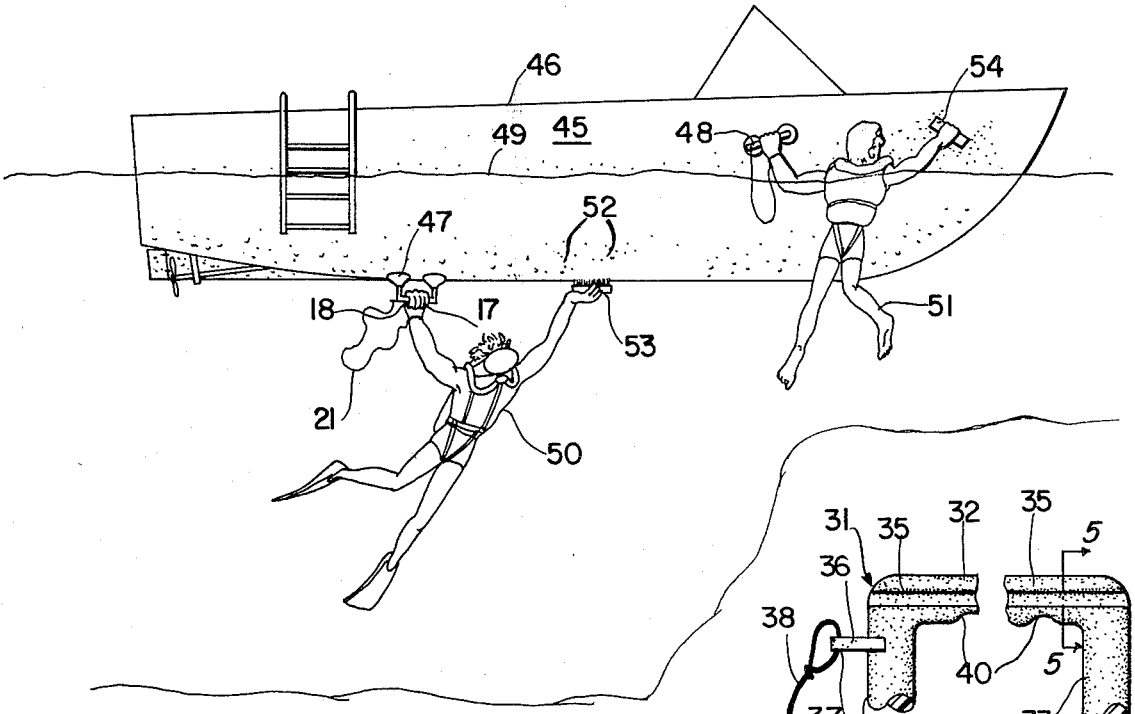
FIG. 1 is a side view in elevation illustrating the holder of the invention removably mounted on the exterior hull surface of a waterborne watercraft both above and below the waterline, and further illustrating the method of the invention for cleaning and maintaining the exterior hull surface of a watercraft by waterborne individuals working both above and below the waterline.
Figure 2:
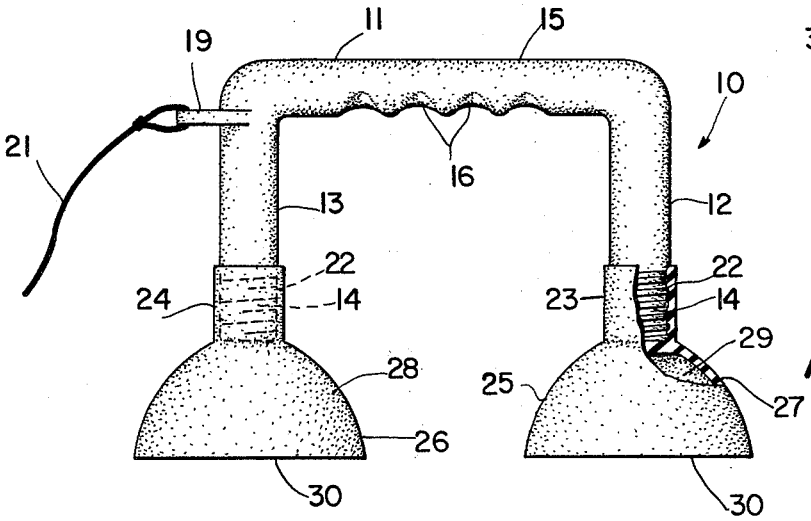
FIG. 2 is a side view in elevation of the holder of the invention.
Figure 3:
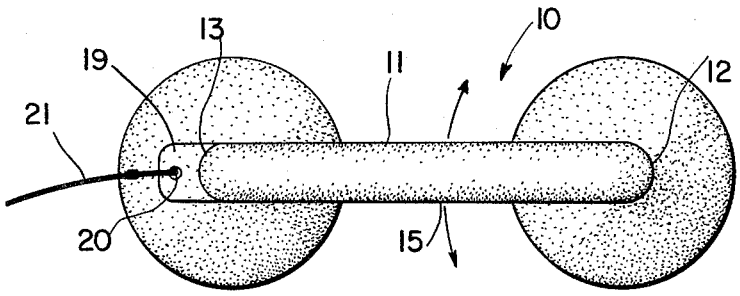
FIG. 3 is a top view of the holder illustrated in FIG. 2.

Referring now to FIGS. 2 and 3 of the drawings, the holder generally designated as 10 includes an inverted U-shaped member 11 having upright or substantially vertical right and left legs 12 and 13 which are provided on their lower end portions with external threads 14. The U-shaped member 11 also includes a horizontal or transversely extending handle 15 which is supported by the upper end portions of legs 12 and 13 and extends therebetween. The undersurface of handle 15 is provided with four spaced indentations 16 for receiving the four fingers 17 of hand 18, as is best seen in FIGS. 1 and 2. The U-shaped member 11 also has a flat extension 19 which is provided with an opening 20 for receiving cord 21.

The external threads 14 on the lower end portions of legs 12 and 13 are in tightly threaded engagement with the internal threads 22 provided in the upper end portions 23 and 24 of suction cups 25 and 26, respectively. The lower portions 27 and 28 of suction cups 25 and 26 are air and watertight, and are constructed so as to be substantially deeper than is conventional. This feature allows the lower portions 27 and 28 to flex and handle 15 to be moved transversely back and forth to some extent with respect to its longitudinal axis without detaching the undersurfaces 30 of suction cups 25 and 26, as is illustrated by the arrows in FIG. 3.

As is well known, the lower portions 27 and 28 of suction cups 25 and 26 are hollow and have thin walls formed of a relatively soft flexible material, such as natural or synthetic rubber. The lower portions 27 and 28 are capable of being compressed upon pushing downward upon handle 15 to thereby expel the fluid, i.e., air or water, from the interiors 29 and produce a partial vacuum therein upon releasing the pressure. This causes the undersurface edges 30 of suction cups 25 and 26 to be in fluid-tight sealing engagement with the smooth watercraft exterior hull surface 45 and the holder 10 is tightly held. The holder 10 is released from the surface 45 by pushing on handle 15 at 90° or transversely to the longitudinal axis thereof until the surfaces 30 separate from the surface 45 and thereby release the vacuum in interiors 29. The foregoing is well known to those skilled in this art and a more detailed discussion is not necessary for an understanding of the operation of holder 10.

The U-shaped member 11 is preferably constructed from lightweight, relatively hard, non-brittle plastic, such as polyurethane, which has a specific gravity less than 1.0 and is capable of being threaded with external threads 14. The plastic has sufficient strength to allow the lower portions 27 and 28 of suction cups 25 and 26 to be compressed against a smooth surface by downward pressure on handle 15 and following release of the pressure, form a vacuum seal with the smooth surface and thereby securely attach the holder 10 to the surface. The plastic also has sufficient strength to allow the holder 10 to be released from the smooth surface following attachment thereto by applying vigorous pressure to handle 15 transverse to the longitudinal axis thereof, as shown by the arrows in FIG. 3. The U-shaped member may have a generally annular cross-section throughout as illustrated in FIGS. 2 and 3, or the handle 15 may be modified to have a generally I-beam cross-sectional configuration.

Referring now to FIGS. 4 and 5, the modified holder 31 includes a U-shaped member 32 having right and left legs 33 and 34. The legs 33 and 34 are of identical construction to right and left legs 12 and 13, respectively, and thus have external threads formed on their lower end portions which receive the internal threads of a pair of suction cups (not shown). The right and left legs 33 and 34 support a horizontally extending handle 35 which has an I-beam cross-sectional configuration. The modified holder 31 is also provided with an extension 36 having an opening 37 formed therein for receiving the cord 38.

In view of the above, the modified holder 31 is identical with holder 10 with the exception of providing an I-beam cross-sectional configuration for the handle 35 rather than the round cross-sectional configuration of handle 15. The I-beam cross-sectional configuration of handle 35 is of importance in this environment. The I-beam configuration results in markedly higher strength and thus conserves plastic and allows the overall weight of holder 35 to be reduced. As is best seen in FIGS. 1 and 5, the handle 35 has rounded edges 39 which allow it to be grasped tightly by the hand 18 without cutting the fingers 17. The undersurface of I-beam 35 also may have identations 40 for receiving the fingers 17 of hand 18 as discussed hereinbefore for indentations 16 on handle 15.

Referring now to FIG. 1 of the drawings, which illustrates the use of the holder 10 of the invention in cleaning and maintaining the exterior hull surface 45 of waterborne watercraft 46, a holder 47 is shown temporarily and removably attached to the exterior hull surface 45 beneath the water level 49, and a second holder 48 is shown temporarily and removably attached to the exterior hull surface 45 above the water level 49. In each instance, the holders 47 and 48 have been attached to the exterior hull surface 45 by means of suction cups 25 and 26 employing the conventional technique, i.e., by pressing down on handle 15 while it is held approximately horizontal to surface 45 to thereby compress the lower portions 27 and 28 of suction cups 25 and 26 against the surface 45 and expel fluid from the interiors 29. This produces a partial vacuum within the interiors 29 upon releasing the downward pressure on handle 15. The surfaces 30 form an air or watertight seal with surface 45, which is substantially smooth, and thereby causes the holders 47 and 48 to be tightly attached to the exterior hull surface 45.

Thereafter, the handles 15 of holders 47 and 48 may be grasped by the diver 50 and the swimmer 51, thereby allowing them to maintain their positions in the water while removing surface contamination 52 from exterior hull surface 45 by means of prior art cleaning devices such as brush 53 and scrubber 54. The holders 47 and 48 are attached to the arms of diver 50 and swimmer 51 by means of cords 21 to thereby assure that the holders 47 and 48 remain in the vicinity of diver 50 and swimmer 51 upon being detached from the exterior hull surface 45. The holders 47 and 48 may be easily detached from the exterior hull surface 45 by applying force transversely with respect to the longitudinal axis of handle 15 in the directions of the arrows illustrated in FIG. 3, and with the transverse force thus applied being of sufficient magnitude to detach the lower sealing surfaces 30 of suction cups 25 and 26 and thereby allow fluid, which may be either water or air as the case may be, to flow into the interiors 29 and thereby break the partial vacuum. The detached holders 47 and 48 thus may be moved to other positions on surface 45 and re-attached thereto as described above. This process is repeated until the entire surface 45 has been cleaned and maintained. The construction of holders 47 and 48 is identical with that of holder 10.

The holder 10 preferably has an overall specific gravity of less than one so that it floats to the surface of the water upon release from surface 45 and is not lost. The cord 21 also aids in this respect as one end is attached to extension 19 and the other end to the diver 50 or swimmer 51. It is understood that plastics other than polyurethanes may be used provided they meet the necessary requirements discussed hereinbefore.

The suction cups 25 and 26 are flexible and have a generally annular transverse cross-section. They are mounted so as to be in axial allignment with the longitudinal axis of the first and second legs, and with the annular outer sealing surfaces thereof 30 being substantially parallel with the longitudinal axis of the handle 15. The suction cups 25 and 26 are sufficiently flexible and have diameters and depths whereby when the holder 15 is tightly attached to a smooth surface 45 by means of the suction cups 25 and 26 with the longitudinal axes of the legs 12 and 13 normally at substantially 90° with respect to the surface 45, the handle 15 may be moved back and forth through a substantial arc transversely with respect to the axis of the handle 15 without detaching the suction cups 25 and 26 from the surface 45. For example, the handle 15 may be moved back and forth through an arc of at least 45°, and preferably at least 90° or 120°, without detaching the suction cups 25 and 26 from the surface 45.

The foregoing detailed description of the invention and the accompanying drawings are for purposes of illustration only, and are not intended as being limiting to the spirit or scope of the appended claims.

I claim:

1. A hand held suction cup mounted holder which may be temporarily tightly and removably attached to a substantially smooth supporting surface and thereafter easily detached from the said supporting surface consisting essentially of a generally U-shaped member, the said U-shaped member when held whereby the U is in the inverted position consisting essentially of an elongated generally transversely extending handle portion having spaced first and second end portions from which spaced substantially parallel first and second legs respectfully extend downward at an approximately 90° angle, the said handle portion and the said first and second legs having lengths sufficient to allow the handle portion to be grasped by the hand but not greatly in excess thereof whereby the holder may be attached to a supporting surface and used effectively in a given position and moved easily from position to position on the said supporting surface, the said handle portion including means whereby it may be grasped firmly by the hand, first and second flexible and resilient suction cups mounted on the outer end portions of the first and second legs respectively by means of cooperating threaded connections therebetween, the first and second suction cups having open outer ends with air and water tight sealing surfaces and fully closed air and water tight inner ends and including continuous air and water tight flexible and resilient cup-shaped walls with generally annular transverse cross-sections, the first and second suction cups being threadedly mounted adjacent their closed inner ends so as to be in axial allignment with the longitudinal axis of the first and second legs respectively and whereby a plane taken through the said outer end sealing surfaces thereof is substantially parallel with the longitudinal axis of the said handle portion, the first and second suction cups being constructed whereby the said walls thereof are free of non-flexible and non-resilient areas, the first and second suction cups being sufficiently flexible and resilient and having diameters and depths whereby when the holder is tightly attached to a smooth surface by means of the sealing surfaces on the open outer ends of the first and second suction cups with the longitudinal axes of the first and second legs normally being at substantially 90° with respect to the smooth surface the handle may be moved transversely back and forth through an arc of at least 45° with respect to the axis of the said handle portion without detaching the said sealing surfaces of the first and second suction cups from the smooth surface, and the holder including means whereby one end of an elongated flexible retaining means may be attached thereto for preventing loss of the holder when in use.

2. The holder of claim 1 wherein the handle may be moved back and forth through an arc of at least 120° without detaching the first and second suction cups from the smooth surface.

3. The holder of claim 1 wherein the handle may be moved back and forth through an arc of at least 90° without detaching the first and second suction cups from the smooth surface.

4. The holder of claim 1 wherein the under surface of the handle has spaced indentations formed therein for receiving the fingers of a hand grasping the holder.

5. The holder of claim 1 wherein the handle has a cross-sectional configuration similar to that of an I-beam.

6. The holder of claim 1 wherein the first and second legs have annular cross-sectional configurations, the said attaching means for the retaining means is an extension carried by the said U-shaped member which has an opening therein for receiving a cord, and the handle has a cross-sectional configuration similar to that of an I-beam.

7. The holder of claim 1 wherein the overall specific gravity thereof is less than 1.0 whereby the holder is buoyant in water.

8. The holder of claim 7 wherein at least the U-shaped member thereof is constructed of a plastic material having a specific gravity less than 1.0.

9. The holder of claim 8 wherein the plastic material comprises polyurethane.

10. The holder of claim 9 wherein the first and second legs have annular cross-sectional configurations, the said attaching means for the retaining means is an extension carried by the said handle portion which has an opening therein for receiving a cord, and the handle has a cross-sectional configuration similar to that of an I-beam.

11. The holder of claim 10 wherein the handle may be moved back and forth through an arc of at least 90° without detaching the first and second suction cups from the smooth surface.

12. The holder of claim 11 wherein the under surface of the handle has spaced indentations formed therein for receiving the fingers of a hand grasping the holder.

13. In a waterborne watercraft having an exterior hull surface which is partially immersed in water, at least a portion of the exterior hull surface above the waterline or below the waterline being substantially smooth whereby a suction cup may be attached thereto, the improvement which comprises a suction cup mounted holder useful in cleaning and maintaining the said exterior hull surface tightly attached to a said substantially smooth portion of the surface thereof, the said holder consisting essentially of an elongated generally transversely extending handle portion having spaced first and second end portions from which spaced substantially parallel first and second legs respectfully extend downward at an approximately 90° angle, the said handle portion and the said first and second legs having lengths sufficient to allow the handle portion to be grasped by the hand but not greatly in excess thereof whereby the holder may be attached to a supporting surface and used effectively in a given position and moved easily from position to position on the said supporting surface, the said handle portion including means whereby it may be grasped firmly by the hand, first and second flexible and resilient suction cups mounted on the outer end portions of the first and second legs respectively by means of cooperating threaded connections therebetween, the first and second suction cups having open outer ends with air and water tight sealing surfaces and fully closed air and water tight inner ends and including continuous air and water tight flexible and resilient cup-shaped walls with generally annular transverse cross-sections, the first and second suction cups being threadedly mounted adjacent their closed inner ends so as to be in axial allignment with the longitudinal axis of the first and second legs respectively and whereby a plane taken through the said outer end sealing surfaces thereof is substantially parallel with the longitudinal axis of the said handle portion, the first and second suction cups being constructed whereby the said walls thereof are free of non-flexible and non-resilient areas, the first and second suction cups being sufficiently flexible and resilient and having diameters and depths whereby when the holder is tightly attached to a smooth surface by means of the sealing surfaces on the open outer ends of the first and second suction cups with the longitudinal axes of the first and second legs normally being at substantially 90° with respect to the smooth surface the handle may be moved transversely back and forth through an arc of at least 45° with respect to the axis of the said handle portion without detaching the said sealing surfaces of the first and second suction cups from the smooth surface, and the holder including means whereby one end of an elongated flexible retaining means may be attached thereto for preventing loss of the holder when in use.

14. The craft of claim 13 wherein the handle may be moved back and forth through an arc of at least 120° without detaching the first and second suction cups from the smooth surface.

15. The craft of claim 13 wherein the handle may be moved back and forth through an arc of at least 90° without detaching the first and second suction cups from the smooth surface.

16. The craft of claim 13 wherein the under surface of the handle has spaced indentations formed therein for receiving the fingers of a hand grasping the holder.

17. The craft of claim 13 wherein the handle has a cross-sectional configuration similar to that of an I-beam.

18. The craft of claim 13 wherein the first and second legs have annular cross-sectional configurations, the said attaching means for the retaining means is an extension carried by the said handle portion which has an opening therein for receiving a cord, and the handle has a cross-sectional configuration similar to that of an I-beam.

19. The craft of claim 13 wherein the overall specific gravity thereof is less than 1.0 whereby the holder is buoyant in water.

20. The craft of claim 19 wherein at least the handle portion thereof is constructed of a plastic material having a specific gravity less than 1.0.

21. The craft of claim 20 wherein the plastic material comprises polyurethane.

22. The craft of claim 21 wherein the first and second legs have annular cross-sectional configurations, the said attaching means for the retaining means is an extension carried by the said handle portion which has an opening therein for receiving a cord, and the handle has a cross-sectional configuration similar to that of an I-beam.

23. The craft of claim 22 wherein the handle may be moved back and forth through an arc of at least 90° without detaching the first and second suction cups from the smooth surface.

24. The craft of claim 23 wherein the under surface of the handle has spaced indentations formed therein for receiving the fingers of a hand grasping the holder.

25. In a method of cleaning and maintaining the exterior hull surface of a waterborne watercraft, the exterior hull surface being partially immersed in the water and at least a portion thereof above the waterline or below the waterline being substantially smooth whereby a suction cup may be attached thereto, the improvement which comprises attaching a holder useful in cleaning and maintaining the said exterior hull surface to a said substantially smooth portion of the surface thereof, the holder consisting essentially of an elongated generally transversely extending handle portion having spaced first and second end portions from which spaced substantially parallel first and second legs respectfully extend downward at an approximately 90° angle, the said handle portion and the said first and second legs having lengths sufficient to allow the handle portion to be grasped by the hand but not greatly in excess thereof whereby the holder may be attached to a supporting surface and used effectively in a given position and moved easily from position to position on the said supporting surface, the said handle portion including means whereby it may be grasped firmly by the hand, first and second flexible and resilient suction cups mounted on the outer end portions of the first and second legs respectively by means of cooperating threaded connections therebetween, the first and second suction cups having open outer ends with air and water tight sealing surfaces and fully closed air and water tight inner ends and including continuous air and water tight flexible and resilient cup-shaped walls with generally annular transverse cross-sections, the first and second suction cups being threadedly mounted adjacent their closed inner ends so as to be in axial allignment with the longitudinal axis of the first and second legs respectively and whereby a plane taken through the said outer end sealing surfaces thereof is substantially parallel with the longitudinal axis of the said handle portion, the first and second suction cups being constructed whereby the said walls thereof are free of non-flexible and non-resilient areas, the first and second suction cups being sufficiently flexible and resilient and having diameters and depths whereby when the holder is tightly attached to a smooth surface by means of the sealing surfaces on the open outer ends of the first and second suction cups with the longitudinal axes of the first and second legs normally being at substantially 90° with respect to the smooth surface the handle may be moved transversely back and forth through an arc of at least 45° with respect to the axis of the said handle portion without detaching the said sealing surfaces of the first and second suction cups from the smooth surface, and the holder including means whereby one end of an elongated flexible retaining means may be attached thereto for preventing loss of the holder when in use.

26. The method of claim 25 wherein the handle may be moved back and forth through an arc of at least 120° without detaching the first and second suction cups from the smooth surface.

27. The method of claim 25 wherein the handle may be moved back and forth through an arc of at least 90° without detaching the first and second suction cups from the smooth surface.

28. The method of claim 25 wherein the under surface of the handle has spaced indentations formed therein for receiving the fingers of a hand grasping the holder.

29. The method of claim 25 wherein the handle has a cross-sectional configuration similar to that of an I-beam.

30. The method of claim 25 wherein the first and second legs have annular cross-sectional configurations, the said attaching means for the retaining means is an extension carried by the said handle portion having an opening therein for receiving a cord, and the handle has a cross-sectional configuration similar to that of an I-beam.

31. The method of claim 25 wherein the overall specific gravity thereof is less than 1.0 whereby the holder is buoyant in water.

32. The method of claim 31 wherein at least the handle portion thereof is constructed of a plastic material having a specific gravity less than 1.0.

33. The method of claim 32 wherein the plastic material comprises polyurethane.

34. The method of claim 33 wherein the first and second legs have annular cross-sectional configurations, the said attaching means for the retaining means is an extension carried by the said handle portion having an opening therein for receiving a cord, and the handle has a cross-sectional configuration similar to that of an I-beam.

35. The method of claim 34 wherein the handle may be moved back and forth through an arc of at least 90° without detaching the first and second suction cups from the smooth surface.

36. The method of claim 35 wherein the under surface of the handle has spaced indentations formed therein for receiving the fingers of a hand grasping the holder.

* * * * *